US007888885B2

(12) United States Patent
Giussani et al.

(10) Patent No.: US 7,888,885 B2
(45) Date of Patent: Feb. 15, 2011

(54) CONTROL CIRCUIT OF A DRIVING CIRCUIT FOR REGULATING THE SWITCHING FREQUENCY OF A DISCHARGE LAMP

(75) Inventors: Luca Giussani, San Vittore Olona (IT); Massimiliano Gobbi, Castel San Giovanni (IT); Luca Salati, Milan (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 896 days.

(21) Appl. No.: 11/753,284

(22) Filed: May 24, 2007

(65) Prior Publication Data

US 2008/0290809 A1 Nov. 27, 2008

(51) Int. Cl.
*G05F 1/00* (2006.01)

(52) U.S. Cl. ..... 315/307; 315/291; 315/247; 315/224; 315/209 R

(58) Field of Classification Search ..... 315/247, 315/224, 225, 209 R, 292, 307–311, DIG. 4, 315/DIG. 5, DIG. 7
See application file for complete search history.

(56) References Cited

U.S. PATENT DOCUMENTS

| | | | | |
|---|---|---|---|---|
| 7,397,197 | B2 * | 7/2008 | Ohta | 315/226 |
| 2002/0011804 | A1 * | 1/2002 | Fujimura et al. | 315/291 |
| 2008/0024075 | A1 * | 1/2008 | Henry | 315/307 |

* cited by examiner

*Primary Examiner*—Tuyet Thi Vo
(74) *Attorney, Agent, or Firm*—Lisa K. Jorgenson; Joshua A. Kading; Seed IP Law Group PLLC

(57) ABSTRACT

A control circuit controls a driving circuit of a discharge lamp. The driving circuit comprises a half bridge and a clock generator that determines the switching frequency of the half bridge. The control circuit comprises a regulator that regulates the value of the switching frequency when the value of the voltage across the lamp exceeds a threshold value.

31 Claims, 4 Drawing Sheets

CONTROL CIRCUIT OF A DRIVING CIRCUIT FOR REGULATING THE SWITCHING FREQUENCY OF A DISCHARGE LAMP

BACKGROUND

1. Technical Field

The invention relates to a control circuit of a driving circuit of a discharge lamp.

2. Description of the Related Art

Fluorescent lamps are typically composed of a glass tube which contains a small quantity of mercury, a low pressure inert gas and phosphorous powders which coat the inside part of the tube. At the extremities two electrodes are present which, connected to a suitable driving circuit, form the arc that permits the discharge of the gas to be generated and maintained.

Among the possible driving circuits the so-called high frequency ballast circuits can be enumerated: these are circuits at whose output an alternating voltage signal is generated at a frequency and amplitude necessary to keep the lamp on; this waveform is produced by a circuit that comprises a couple of transistors that switch at a frequency of tens of KHz, a current limiting coil and a filtering capacitance.

A typical ballast circuit is described in FIG. 1 where a half-bridge circuit, which comprises the transistors T1 and T2 and is arranged between an high voltage Vh and ground GND, drives a lamp LP by means of a voltage Vin. The circuit in FIG. 1 shows an inductance L for limiting the current which is arranged between the common terminal of the transistor T1 and T2 and the lamp LP, a filter capacitor C arranged in parallel to the lamp LP and a capacitor Clp arranged between the lamp LP and ground GND. A driving circuit 1 drives the half bridge so that a voltage Vin is across the lamp LP and the inductance L and a voltage Vout is across the capacitor C. The lamp LP can be considered an "open circuit" before the ignition and as a resistor when the lamp is turned on.

The frequency response of the circuit in FIG. 1 is shown in FIG. 2. The lamp ignition is achieved in three phases each one of which corresponds to an operative point on the waveform in FIG. 2.

In a first phase, that is a preheating phase, the lamp is off and the corresponding point in the waveform in FIG. 2 is a point of the line A. During the first phase the resonant circuit is driven with a high frequency signal for preheating the electrodes of the lamp; the current and the voltage across the lamp are at the minimum root-mean square value. The half bridge drives a load of inductive type because the operative point is at a frequency higher than the frequency fr(HighQ) on the diagram in FIG. 2.

In a second phase, that is the ignition phase, the switching frequency of the transistors of the half bridge is decreased by providing an increase of the current and of the voltage of the lamp. Such an increase occurs to reach the ignition voltage of the gas which allows the ignition of the lamp. During this phase, the operative point goes towards fr(HighQ) on the line A in the diagram in FIG. 2: the half bridge drives a load of the inductive type if the ignition of the lamp occurs before the frequency reaches the value fr(HighQ). The situation wherein the lamp ignites close to the resonance frequency fr(HighQ) leads to a condition wherein the voltage and current assume too high values which could cause the destruction of the transistors of the half bridge. This is possible in the case of the ageing of the lamp which causes the increase of the ignition voltage of the gas with corresponding decrease of the frequency value corresponding to the ignition.

In the third phase, the run/burn phase or run phase, the load driven by the half bridge will be of the inductive type but with a resistor (the lamp) in series with the capacitor C and the inductor L. The operative point is on the line B of the diagram in FIG. 2 and it is characterized by the minimum frequency value and by voltage/current values of the lamp which are lower than ignition values and higher than the preheating values. In this case the correct operating condition is that where the load is a load of the inductive type, that is the operating frequency remains above the new resonance frequency fr(LowQ). If the lamp is damaged so that the operating frequency is too close to the resonance frequency fr(LowQ), the reached voltage and current high values could bring to the destruction of the transistors of the half bridge. Also, since the lamp in this phase is turned on, a sudden variation of the resistive value of the lamp could cause an increase of the quality factor Q with a movement of the operating point on a line C of the diagram in FIG. 2 (capacitive performance) and determining a condition of "hard switching" which is very dangerous for the half bridge.

BRIEF SUMMARY

One embodiment of the present invention provides a control circuit of a driving circuit of a discharge lamp which overcomes the above mentioned disadvantages.

One embodiment of the present invention is a control circuit that includes a sensor structured to sense a voltage of a discharge lamp driven by a driving circuit that includes a half bridge and a circuit that determines a switching frequency of the half bridge. The control circuit also includes a regulator structured to regulate the switching frequency when the voltage across the lamp exceeds a threshold value.

BRIEF DESCRIPTION OF THE SEVERAL VIEWS OF THE DRAWINGS

The features and the advantages of the present invention will be made evident by the following detailed description of an embodiment thereof, shown as not limiting example in the annexed drawings, wherein.

DETAILED DESCRIPTION

Figure 1:
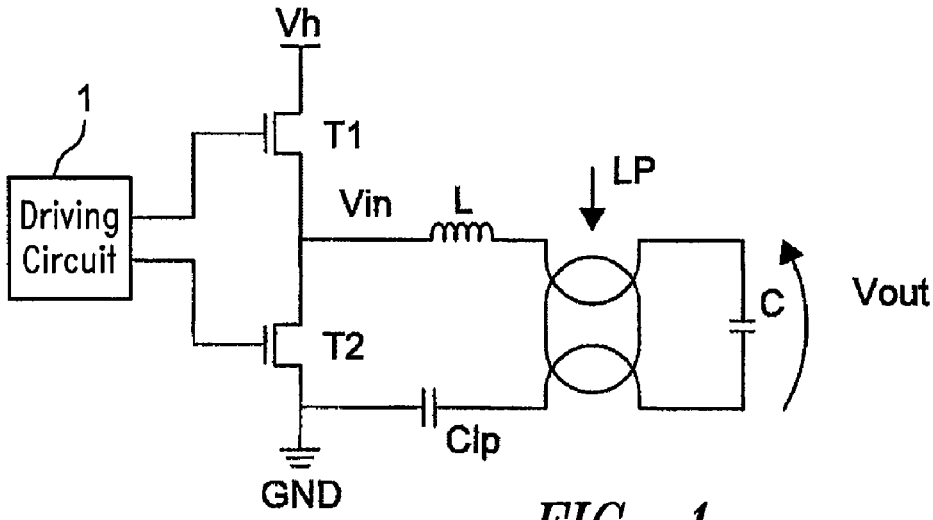
FIG. 1 (Prior Art)
FIG. 1 is a schematic view of a driving circuit for a discharge lamp according to prior art.
Figure 2:
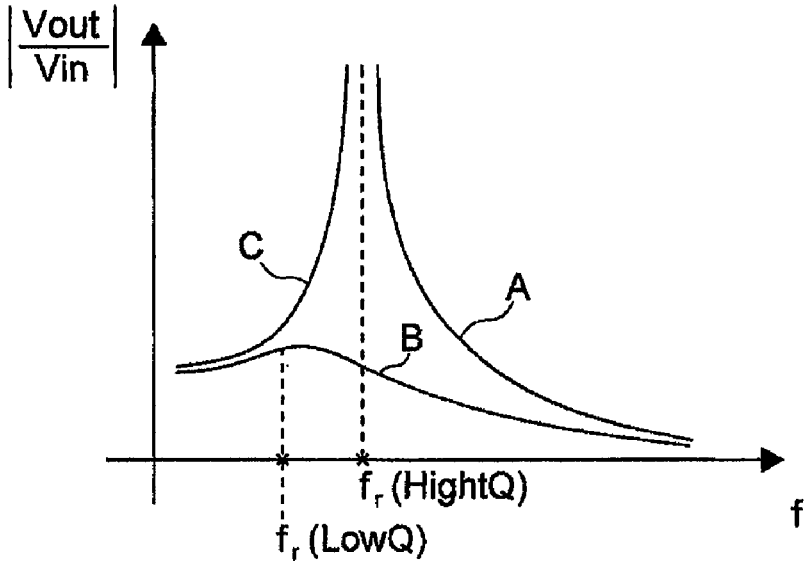
FIG. 2 is a diagram of the absolute value of the rate between the output voltage and the input voltage of the discharge lamp as a function of the frequency.
Figure 3:
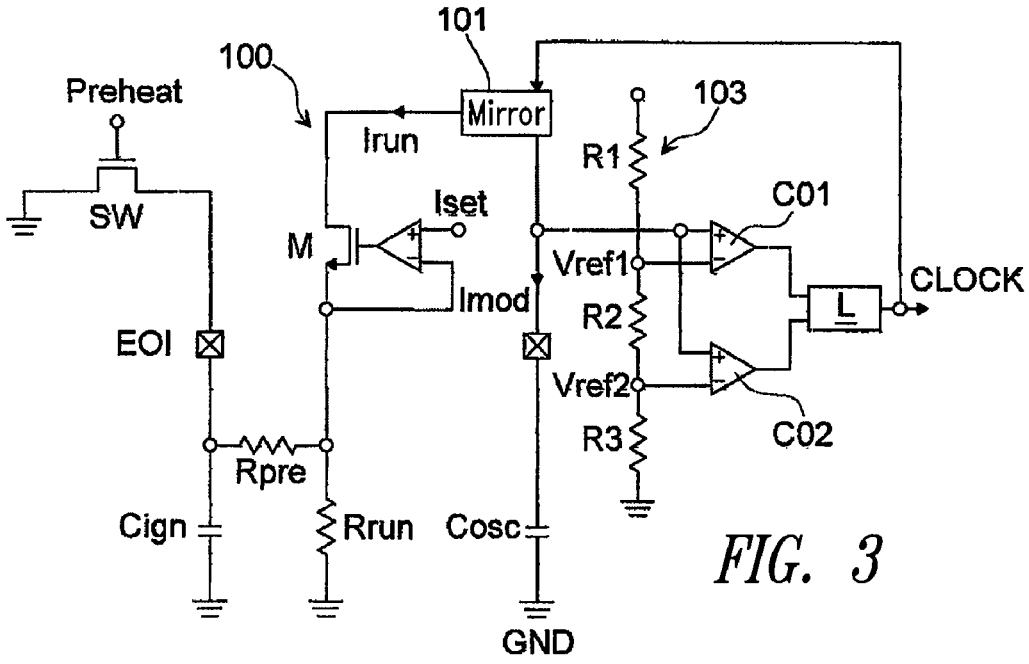
FIG. 3 is a schematic view of a known generator of a switching frequency for driving the lamp.

With reference to FIG. 3 a generator of the switching frequency for driving the lamp is shown. The generator comprises a device 100 adapted to generate a reference current Irun that is mirrored by means of a mirror device 101, wherein the current Irun is multiplied by four by obtaining a current Imod. The last is used for discharging and/or charging an external capacitance Cosc connected to ground GND and the voltage measured at the terminals of said capacitance is compared with two voltage thresholds Vref1 and Vref2 generated by means of a resistive divider 103 consisting of the series of the resistances R1, R2 and R3 which is arranged between a voltage reference Vref and ground GND and of two comparators CO1 and CO2 having the non-inverting input terminals connected with a terminal of the capacitance Cosc and the inverting input terminals connected respectively with the common terminal of the resistances R2 and R3 and the common terminal of the resistances R1 and R2. The outputs of the comparators are adapted to generate the clock signal CLOCK. The device 100 comprises an operational amplifier having the non-inverting input terminal connected with a reference current Iset and the inverting input terminal connected with the source terminal of a MOS transistor M having the gate terminal connected with the output of the operational amplifier and the drain terminal connected with the mirror device 101. The source terminal of the MOS transistor M is connected with a resistance Rrun connected to ground and with a resistance Rpre connected with a terminal of a capacitor Cign having the other terminal connected to ground. The common terminal EOI of the resistance Rpre and the capacitor Cign is connected with a switch SW driven by a voltage Preheat.

The switching frequency Fsw is substantially determined by the value of the current Irun which changes on the base of the operative conditions, that is the pre-heating phase, the ignition phase and the run phase. During the pre-heating phase the terminal EOI is short circuited to ground because the switch SW is on and in this way the current Irun is at the maximum value. At the end of this first operative condition the switch SW is turned off and the charge of the capacitor Cign starts; in this way the voltage across the capacitor Cign increases exponentially, the current Irun and the switching frequency decrease exponentially to a minimum value. The reaching of the minimum value determines the end of the ignition phase and the start of the run phase; the duration T of the ignition phase is T=3*Rign*Cign. During this time interval the system applies the shift of the switching frequency which is necessary to increase the voltage across the lamp to the value of the ignition of the gas.

Figure 4:
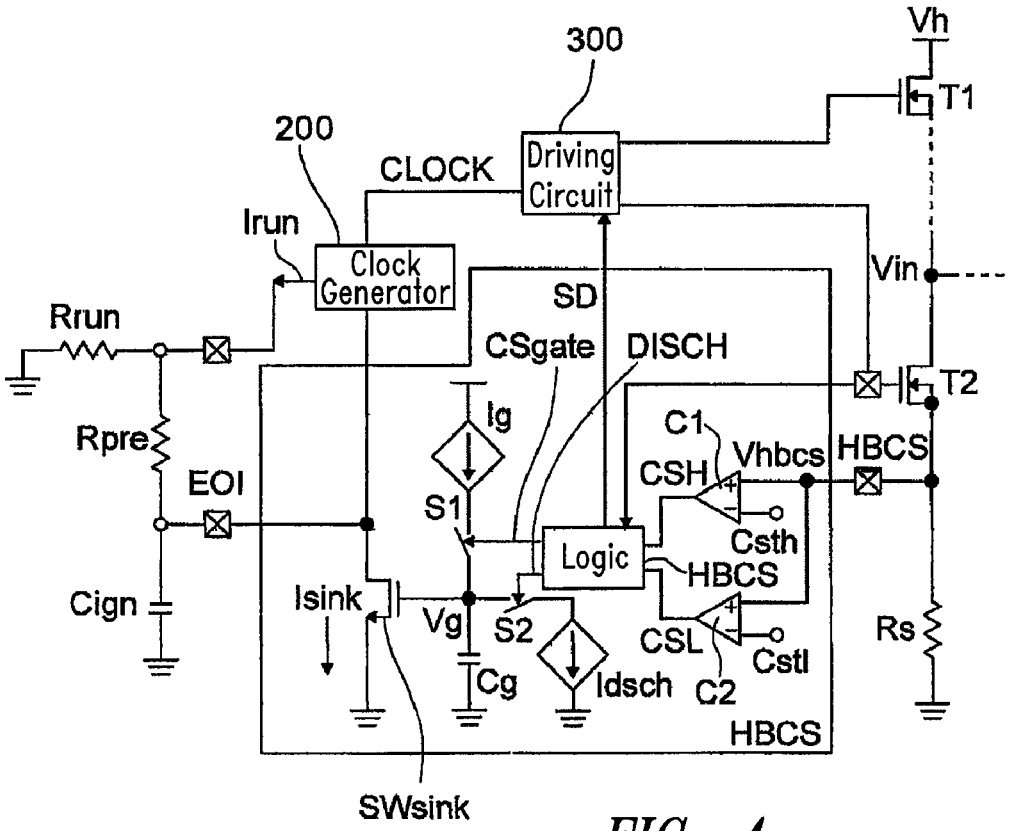
FIG. 4 is a schematic view of a control circuit of a driving circuit of a discharge lamp according to one embodiment of the present invention.

The circuit of one embodiment of the present invention, shown in FIG. 4, acts on the current Irun in order to regulate the value of the switching frequency Fsw and thus to limit the current and the voltage of the lamp.

By considering the circuit in FIG. 4, the peak of the current of the resonance circuit is detected by means of a sense resistance Rs connected between the source of the transistor T2 and ground GND. The peak of the current is detected by means of a voltage Vhbcs measured across the resistance Rs. This voltage is compared with two reference thresholds Csth and Cstl by means of two comparators C1 and C2 having the non inverting input terminal connected with a terminal of the resistance Rs and the inverting input terminals respectively connected with the reference thresholds Csth and Cstl. A logic circuit HBCS receives the output signals CSH and CSL of the comparators C1 and C2 and operates two different typologies of intervention according to the operative phase of the system.

During the ignition phase the goal of the circuit HCBS is to limit the voltage and the current of the lamp LP to prevent that they exceed the nominal values in a dangerous way. Therefore a security margin of voltage dvign and a security margin of current dlgn are defined so that, by means of a suitable design of Rs, it verifies the following relation Vhbcs=Rs*(lign+dlign)≧Csth wherein the current and the voltage must be considered as peak values.

If the lamp is working properly, it ignites when Vlamp=Vign and therefore the voltage Vhbcs is lower than Csth. If, for example in the case of ageing of the lamp, the ignition of the lamp does not occur with Vlamp=Vign, then Vhbcs>Csth and the circuit HBCS acts to limit the switching frequency Fsw. In fact the circuit HBCS allows the increase of the current Irun by limiting the exponential increase of the voltage Veoi across the capacitor Cign; in FIG. 4 the current Irun derives from a clock generator 200 which may comprise the device 100, 101 and 103 in FIG. 3. In this way the shifting of the switching frequency Fsw is stopped thus limiting the voltage Vlamp at the value Vlamp=Vign+dVign. The clamping operation of the voltage Veoi occurs by means adapted to discharge the capacitor Cign of a small quantity, which means may include a MOS transistor SWsink having the drain terminal connected to a terminal EOI of the capacitor Cign, the source terminal connected to ground GND and the gate terminal driven by a suitable voltage Vg generated by modulating the charge time of a capacitor Cg connected between the gate terminal of the transistor SWsink and ground GND. The voltage Vg depends on the difference between the voltages Vhbcs and the reference threshold Csth, the higher the voltage Vhbcs the higher the voltage Vg; in this way as the current Isink is higher as the voltage Veoi is lower. The gate terminal of the transistor SWsink is coupled with a current generator Ig, which provides to charge the capacitor Cg, by means of a switch S1 while it is connected to a current generator Idsch, which provides to discharge the capacitor Cg, by means of a switch S2; the switches S1 and S2 are controlled by the circuit HBCS by means of two signals CSgate and DISCH. The signal DISCH filters spurious peaks and discharges the capacitor Cg in short time after the overcurrent condition has ended, that is the overcoming of the threshold is ended, without using reset signals.

This regulation condition of the switching frequency, which determines an increase of the duration of the ignition phase, is active until the ignition of the lamp. The circuit HBCS sets a maximum duration of the regulation procedure, that is a maximum interval Treg during which a voltage higher than Vign+dVign is applied across the lamp. If at the end of the time period Treg the lamp has still not ignited, the circuit HBCS waits the first conduction cycle of the transistor T2 during which it checks two possible events: if the voltage at the gate terminal of the transistor T2 is high and the signal CSH is high, that is the lamp has not ignited and the over voltage is still present or if the voltage at the gate terminal of the transistor T2 is high and the signal CSH is low, the lamp has ignited at the limit of the time period Treg. If the first event is verified the circuit HBCS controls the shut down of the whole system, by means of a signal SD sent to a driving circuit 300 of the half bridge, while if the second event is verified the circuit HBCS controls the resumption of the ignition phase.

When the ignition occurs the values of Vlamp and Ilamp decrease for the variation of the equivalent load of the half bridge; the regulation action is interrupted and the shift of the switching frequency is resumed until the starting of the run phase. During this phase the circuit HBCS is still active but in this case a security margin of the voltage or of the current dVign or dlgn is defined so that, by means of a suitable design of Rs, it verifies the following relation Vhbcs=Rs*(Irun+dIrun)≧Cstl, wherein the current and the voltage must be considered as peak values; the values of the voltages and the currents in this phase are lower than in the ignition phase, that is Irun<lign and Csth>Cstl. In the case wherein the above condition occurs, the circuit HBCS controls the increase of the switching frequency, by acting on the switch S1 in order to increase the voltage Vg and in turn the current Isink which provides, by reducing the value of the voltage Veoi, to increase the current Irun. In this way the operating point of the driving circuit is moved to lower value of the currents and voltages. Even in this case the regulation continues for the above mentioned time period Treg; after the time period the following events are checked: if the voltage at the gate terminal of the transistor T2 is high and the signal CSL is high, then the fault condition is still present and the regulation has not been successful, or if the voltage at the gate terminal of the transistor T2 is high and the signal CSL is low, that is the fault condition has been corrected by the frequency adjustment and the voltage Vhbcs is under the value of the threshold Cstl. If the first event is verified the circuit HBCS controls the shut down of the whole system while if the second event is verified the circuit HBCS controls the resumption of the run phase.

When the system is in the run phase the circuit HBCS may detect a second type of fault condition, that is when the voltage Vhbcs is higher than or equal to the threshold Csth. If this condition is verified during the run phase, the circuit HBCS does not provide to any regulation but it controls the shut down of the whole system.

Figure 5:
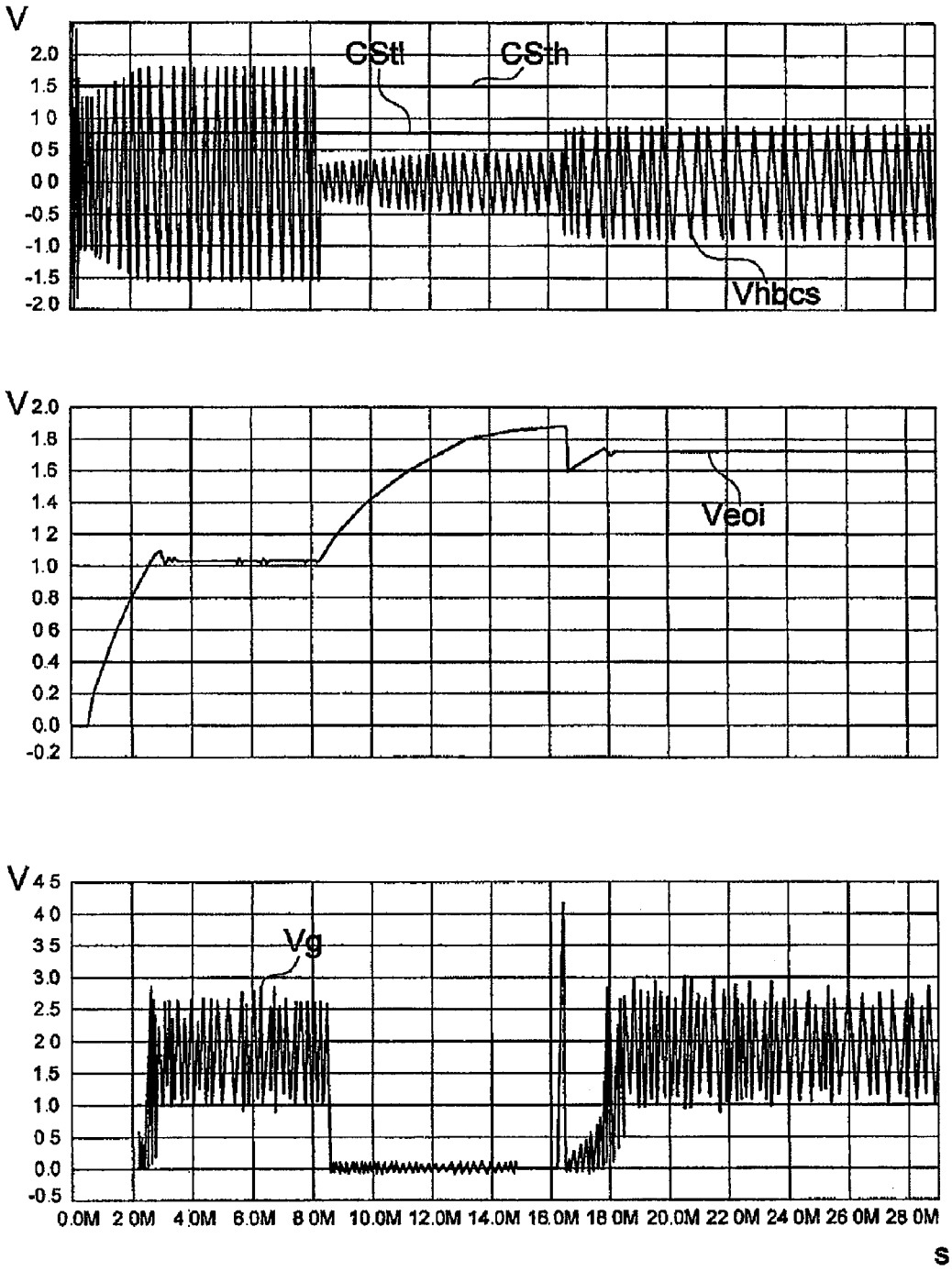
FIG. 5 shows time diagrams of some voltages of the circuit in FIG. 4.
Figure 6:
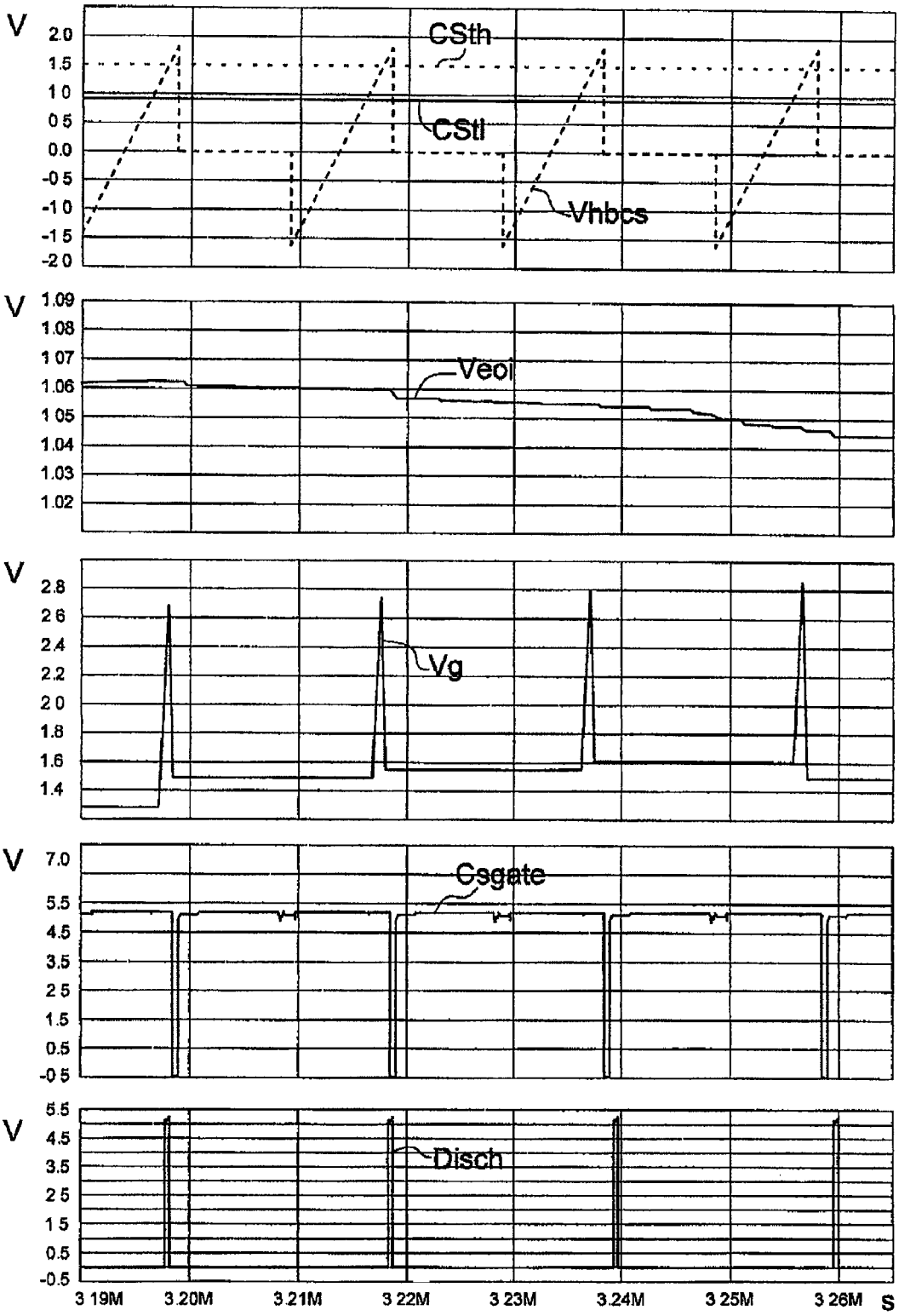
FIG. 6 shows the time diagrams in FIG. 5 in a particular time interval wherein the circuit in FIG. 4 operates.

In FIG. 5 the time diagrams of the voltages Vhbcs, Csth, Cstl, Vg and the voltage Veoi across the capacitor Cign are shown; the ignition phase occurs when the voltage Veoi rises from 0 to the value of 1.9 Volt while the run phase occurs successively. In FIG. 6 the time diagrams of the voltages in FIG. 5 and the voltages CSgate and DISCH for a time interval of the ignition phase wherein the circuit in FIG. 4 operates.

The various embodiments described above can be combined to provide further embodiments. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A control circuit, comprising:

a sensor structured to sense a voltage of a discharge lamp driven by a driving circuit that includes a half bridge and a circuit that determines a switching frequency of the half bridge; and regulating means for regulating the switching frequency when the voltage across the lamp exceeds a threshold value, the threshold value comprising a first value and a second value, the threshold value being the first value when the driving circuit ignites and being the second value when the driving circuit runs the discharge lamp.

2. The control circuit according to claim 1, wherein said regulating means are structured to clamp or to increase the switching frequency during an ignition phase of said discharge lamp.

3. The control circuit according to claim 1, wherein said regulating means are structured to increase the switching frequency during a run phase of said discharge lamp.

4. The control circuit according to claim 1, further comprising means for setting a maximum time interval in which the value of the switching frequency is regulated.

5. The control circuit according to claim 4, wherein said regulating means are structured to clamp or to increase the switching frequency during an ignition phase and to turn off the driving circuit if at the end of said maximum time interval the lamp is not ignited.

6. The control circuit according to claim 4, wherein said regulating means are structured to increase the switching frequency during a run phase and to turn off the driving circuit if at the end of said maximum time interval the voltage across the discharge lamp is lower than the threshold value.

7. The control circuit according to claim 1, the first value being higher than the second value.

8. The control circuit according to claim 7, wherein said regulating means are structured to turn off the driving circuitry when the voltage across the lamp equals or overcomes said first value.

9. The control circuit according to claim 1, wherein said regulating means is structured to increase a current generated by the circuit that determines the switching frequency of the half bridge.

10. The control circuit according to claim 9, wherein said current depends on a voltage across a capacitor, said regulating means comprising further means for exponentially changing said voltage across the capacitor.

11. The control circuit according to claim 10, wherein said further means comprise a transistor having conduction terminals coupled with terminals of the capacitor and a control terminal coupled with a terminal of another capacitor, said regulating means comprising means for charging or discharge said another capacitor.

12. The control circuit according to claim 11, wherein said charging or discharging means comprise first and second current generators and first and second switches arranged between the control terminal of said transistor and the respective first and second current generators, said regulating means comprise a logic circuit structured to control said first and second switches based on the voltage across the lamp exceeding said threshold value.

13. A driving circuit for a discharge lamp, comprising:

a half bridge structured to drive the discharge lamp;

a clock generator structured to determine a switching frequency of the half bridge; and a control circuit structure to control the half bridge, the control circuit including:

a sensor structured to sense a voltage across the lamp; and a regulator structured to regulate the switching frequency when the voltage across the lamp exceeds a threshold value, the threshold value comprising a first value and a second value, the threshold value being the first value during an ignition phase and being the second value during a run phase of the discharge lamp.

14. The driving circuit according to claim 13, wherein said regulator includes a clamping circuit structured to clamp the switching frequency during an ignition phase of said discharge lamp.

15. The driving circuit according to claim 13, wherein said regulator is structured to turn off the half bridge if the lamp is not ignited within a maximum time interval.

16. The driving circuit according to claim 13, the first value being higher than the second value.

17. The driving circuit according to claim 13, further comprising first and second capacitors, wherein said regulator includes:

a transistor having conduction terminals coupled with terminals of the first capacitor and a control terminal coupled with a terminal of the second capacitor;

a first switch structured to charge said second capacitor; and a second switch structured to discharge said second capacitor.

18. The driving circuit according to claim 17, wherein said regulator includes a logic circuit structured to control said first and second switches based on the voltage across the lamp exceeding said threshold value.

19. A method for controlling a discharge lamp, comprising:

sensing a voltage across the discharge lamp; and regulating a switching frequency of a half bridge that drives the lamp, the regulating step occurring while sensing that the voltage across the lamp exceeds a threshold value, the threshold value comprising a first value and a second value, the threshold value being the first value during an ignition phase and being the second value during a run phase of the discharge lamp.

20. The method according to claim 19, comprising, during a phase in which the driving circuit ignites the lamp, clamping the switching frequency for a maximum time period when the voltage across the lamp exceeds said threshold value.

21. The method according to claim 20, comprising turning off the half bridge if at the end of said maximum time period the lamp is not ignited.

22. The method according to claim 20, comprising turning off the half bridge if at the end of said maximum time period the voltage across the discharge lamp is lower than the threshold value.

23. The method according to claim 19, comprising, during a phase in which the lamp is running, increasing the switching frequency for a time period when the voltage across the lamp exceeds said threshold value.

24. The method according to claim 23, the first value being higher than the second value.

25. The method according to claim 24, comprising, during the run phase, turning off the half bridge when the voltage across the lamp equals or overcomes said first value.

26. A lighting device, comprising:

a discharge lamp;

a half bridge structured to drive the discharge lamp;

a clock generator structured to determine a switching frequency of the half bridge; and a control circuit structure to control the half bridge, the control circuit including:

a sensor structured to sense a voltage across the lamp; and a regulator structured to regulate the switching frequency when the voltage across the lamp exceeds a threshold value, the threshold value comprising a first value and a second value, the threshold value being the first value during an ignition phase and being the second value during a run phase of the discharge lamp.

27. The lighting device according to claim 26, wherein said regulator includes a clamping circuit structured to clamp the switching frequency during an ignition phase of said discharge lamp.

28. The lighting device according to claim 26, wherein said regulator is structured to turn off the half bridge if the lamp is not ignited within a maximum time interval.

29. The lighting device according to claim 26, the first value being higher than the second value.

30. The lighting device according to claim 26, further comprising first and second capacitors, wherein said regulator includes:

a transistor having conduction terminals coupled with terminals of the first capacitor and a control terminal coupled with a terminal of the second capacitor;

a first switch structured to charge said second capacitor; and a second switch structured to discharge said second capacitor.

31. The lighting device according to claim 30, wherein said regulator includes a logic circuit structured to control said first and second switches based on the voltage across the lamp exceeding said threshold value.

* * * * *